US005915771A

United States Patent [19]

Amron

[11] Patent Number: 5,915,771

[45] Date of Patent: Jun. 29, 1999

[54] PRESSURIZED TOY WATER GUN WITH SELECTIVE PRESSURIZATION

[75] Inventor: Alan Amron, Syossett, N.Y.

[73] Assignee: Amron Development, Inc., Syosset, N.Y.

[21] Appl. No.: 08/500,240

[22] Filed: Jul. 10, 1995

[51] Int. Cl.[6] ..... A63H 3/18

[52] U.S. Cl. ..... 222/79; 222/401

[58] Field of Search ..... 222/79, 401; 446/405, 446/473

[56] References Cited

U.S. PATENT DOCUMENTS 5,074,439 12/1991 D'Andrade et al. ..... 222/79
5,366,108 11/1994 Darling ..... 222/79 X

FOREIGN PATENT DOCUMENTS 9400210 1/1994 WIPO ..... 446/473

*Primary Examiner*—Joseph A. Kaufman
*Attorney, Agent, or Firm*—Brian K. Dinicola

[57] ABSTRACT

A fluid-ejecting toy in which the fluid storage reservoir may be selectively charged either with pressurized water from a municipal water supply or, when a pressurized source of supply is unavailable, with unpressurized water that is subsequently pressurized within the reservoir via a manually operable pump. In an illustrative embodiment, the receptacle has a one way valve that allows only pressurized water to enter the receptacle. A variety of ways of charging the reservoir with unpressurized water may be employed. By way of example, the reservoir may be configured as a removable structure having a mating threaded engagement with an adapter incorporating the one way valve. The toy is provided with a manually operable pump for charging fluid received in an unpressurized condition.

17 Claims, 3 Drawing Sheets

PRESSURIZED TOY WATER GUN WITH SELECTIVE PRESSURIZATION

FIELD OF THE INVENTION

The present invention relates generally to toy water gun systems having a pressurized receptacle and, more particularly, to guns employing a receptacle that is at least partially pressurized by a municipal water supply.

BACKGROUND OF THE INVENTION

Water guns have for decades been a very popular child's toy. Since the toy industry is very competitive, hundreds of different style water guns have been developed in an attempt to profit from the toy's inherent popularity. The most traditional forms of water guns are activated by a pumping action, either manually through the trigger or automatically through a battery operated motor. Because the range and volume of water expelled in such water pistols is limited by the throw of the pistol trigger, relatively sophisticated water guns have been introduced for expanding both the range of water guns and the volume of the water stream that the water guns can produce. Typically, these guns work upon the principle of pressure differentials between the water held within the toy and the atmosphere. The water within the toy is subjected to a pressure higher than that of the ambient air. As a result, when the water within the toy is given an avenue of escape, the water will stream out under the pressure.

Prior art that shows pressure differential types of water guns are exemplified by U.S. Pat. No. 3,197,070 to Curtis F. Pearl et al, which shows a water gun activated by trapping water in a collapsible area. As the device is collapsed, the pressure of the water builds, spraying the water out of the small orifice left within the pressured volume. Once the confined volume is fully collapsed, the re-expansion of the volume draws forth more water from a reservoir, thus priming the water gun for another cycle. The water being pressurized is limited to the volume of the collapsible volume. The Pearl U.S. Pat. No. 3,197,070 invention cannot store pressurized water for use at a later time, nor can the pressure of the water be increased by cycling the pumping action of the invention while restraining water discharge.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the clamp, allowing the water to flow from the expanded bladder.

Water guns have also been developed that use air pressure to pressurize water and force water through squirt channels. Such toys that use air pumps to pressurize water are exemplified by U.S. Pat. No. 4,214,674 to Jones et al, which shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger, U.S. Pat. No. 5,074,437 D'Andrade et al. also discloses a water gun that pressurizes water by establishing fluid communication between a water reservoir and an air reservoir, and providing means for pressurizing the air reservoir to expel water from the gun when the gun's trigger is pulled.

While pressurized water guns equipped with a hand operated pump, in particular, have enjoyed considerable commercial success, the need to repeatedly operate the pumping mechanism, often twenty five times or more, to achieve adequate air pressurization within the reservoir, presents a challenge to the impatient user. Recognizing this deficiency, it has been proposed by Darling, in U.S. Pat. No. 5,366,108, to omit the air pressurizing mechanism in favor of a one-way valve so that a source of previously pressurized water, i.e., a municipal water supply, may be used to charge a receptacle that contains trapped air. While the Darling device advantageously enables the user to simultaneously combine the water charging and pressurizing steps, however, it is only useful where access to a municipal water supply is readily available. Accordingly, after the initial supply of pressurized water is exhausted, it can not be used at such locations as the beach, the playground, or like.

SUMMARY OF THE INVENTION

Accordingly, it is an object of the present invention to provide a pressurized water gun device which is capable of advantageously utilizing a municipal water supply to pressurize a fluid stored in the receptacle thereof, when such a source of water is available.

It is a further object of the present invention to provide a pressurized water gun device that enables the user to utilize a non-pressurized source of water, when such source is the only one available.

It is yet another object of the present invention to provide an adaptor assembly by which any commercially available air pump-type water gun may be modified to obtain the aforementioned capabilities.

The aforementioned objects, as well as others which will become apparent to those skilled in the art from the teachings set forth herein, are achieved by a water gun which utilizes an interface or adaptor assembly that includes a one-way valve to selectively charge a water reservoir tank with pressurized water from a municipal water supply.

A water gun constructed in accordance with an illustrative embodiment of the present invention comprises a housing and an extended handle connected to the housing. A barrel portion of the housing extends outwardly away from the handle. The water gun further comprises a nozzle having an orifice therethrough, the nozzle being affixed to the end of the barrel portion, and a high pressure, water storage reservoir having an orifice. An avenue of release connects the nozzle to the water storage reservoir, and a trigger is located on the housing adjacent the handle. A controlling means connected to the avenue of release regulates the flow of water and air through the avenue of release and a one-way valve assembly selectively establishes fluid communication between an external, pressurized water source and the water storage reservoir.

Since it is contemplated that a supply of pressurized water will not always be available, the water gun of the present invention further includes a pressuring means with a slider, for pressurizing the water storage reservoir with air. The pressurizing means is preferably configured as an integral part of the water gun housing.

BRIEF DESCRIPTION OF THE DRAWINGS

The details of the present invention, both as to its construction and operation, can best be understood in reference to the accompanying drawings, in which like numerals refer to like parts, and in which.

DETAILED DESCRIPTION OF THE PRESENTLY PREFERRED EMBODIMENTS

Figure 1:
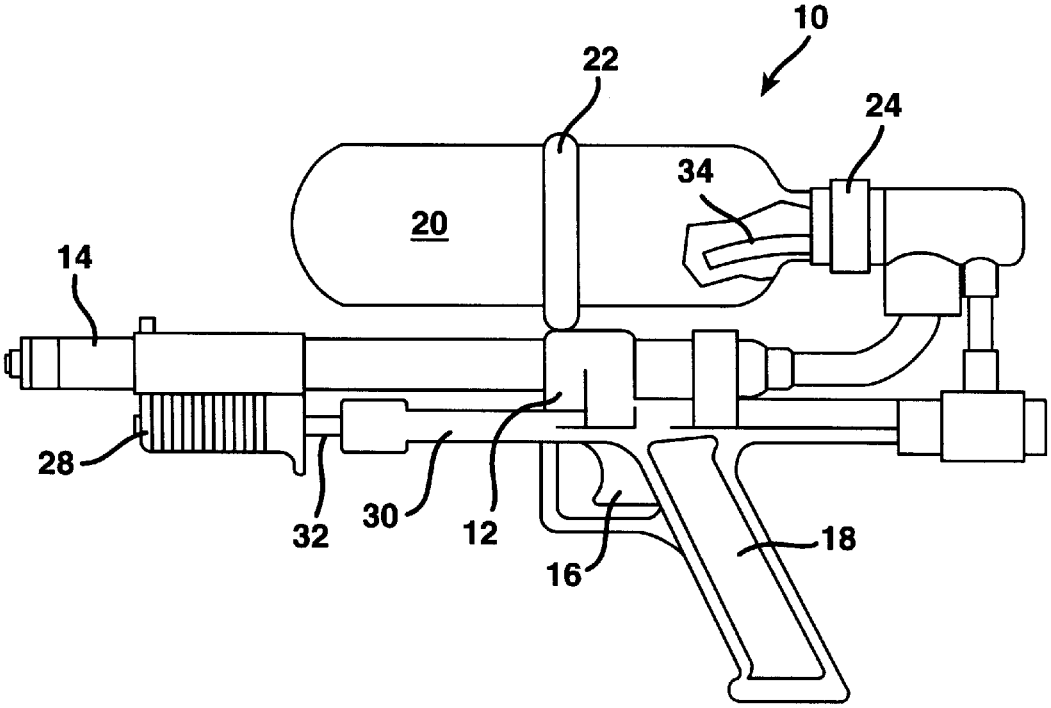
FIG. 1 PRIOR ART
FIG. 1 is a side elevation view depicting a conventional pressurized water gun.

Referring now to FIG. 1, there is shown a conventional water gun indicated generally at reference numeral 10. Throughout the several views, like elements are represented by like reference numerals. Essentially, the water gun depicted in FIG. 1 is described in U.S. Pat. No. 5,074,437, issued on Dec. 24, 1991 to D'Andrade, et al and entitled PINCH TRIGGER PUMP WATER GUN, which patent is expressly incorporated herein by reference in its entirety. It will, however, be readily ascertained by those skilled in the art that the teachings of the present invention are equally applicable to any water gun apparatus utilizing a pressurized receptacle and that the particular configuration depicted in FIG. 1 is for illustrative purposes only.

In any event, and with continued reference to FIG. 1, it can be seen that conventional water gun 10 includes a main housing 12 with an extending barrel 14, trigger 16, and handle 18. The detachable water reservoir 20 is held to the main housing 12 via an attachment collar 22 and reservoir mount 24. In the illustrative prior art apparatus of FIG. 1, the air pump (not shown) is embodied within the main housing 12 but the handle to the pump is attached to the slider handle 28 that travels along, and is guided by the water gun barrel 14.

As is described in the above-identified patent, the water reservoir 20 is cylindrical and has a threaded orifice (not shown). To fill the water reservoir 20 with water, the water reservoir must be detached from correspondingly threaded reservoir mount 24 by unscrewing the threaded orifice therefrom. Water may then be placed into the reservoir 20 and the water reservoir 20 is rethreaded into position shown in FIG. 1. Once filled with water, the water gun 10 is operated by pressurizing the water reservoir 20 with air.

Air is forced into the reservoir by the relative movement of a piston (not shown) within air pump shaft 30. The piston is operated by a pump rod 32 that connects the piston to the slider handle 28. A user holds the slider handle 28 with one hand and the gun handle 18 with the other. The slider handle 28 is then moved back and forth manually along the length of the barrel 14. The back and forth action is transferred to the piston, which forces air past a one way flow valve, through a length of air flow tubing, through a water backflow prevention flap (none of which are shown) and into the water reservoir 20. Air is continuously added to the water reservoir 20 until a desired pressure is reached. Water is discharged, upon depression of trigger 16, via tube 34 which tube extends into reservoir 20.

As will be readily appreciated by those skilled in the art, this configuration enables the user to charge the reservoir with water from any available source such, for example, as a water fountain, swimming pool, stream or pond, or municipal water supply. However, the effort required to adequately pressurize the same is quite considerable and may take several minutes to achieve the desired level, even when a source of pressurized water is already available. Accordingly, a water gun constructed in accordance with the present invention utilizes an adaptor which acts as an interface for establishing fluid communication between the source of pressurized water, e.g. a municipal water supply, and water reservoir 20. An illustrative embodiment of an adaptor assembly 40 constructed in accordance with the present invention is depicted in FIG. 2.

Adaptor assembly 40 comprises a tubular member 42 having a first open end 44 configured for sealing engagement with the neck of water reservoir 20 and a second open end 45 configured for sealing engagement with reservoir mount 34. In the illustrative embodiment of FIG. 2, first open end 44 comprises a female fitting having interior threads for complementary engagement with the exterior threads on the neck of reservoir 20 while the second open end 45 comprises a male fitting having exterior threads for complementary engagement with the interior threads within the bore or reservoir mount 34. It will, of course, be readily appreciated that open ends of tubular member 42 may be readily modified as needed to provide a sealed interface between the reservoir and reservoir mount and that the precise configuration thereof will necessarily depend upon the external and internal shape of each. Thus by way of additional illustrative examples, the threads may be reversed or, if desired, compression fittings may be utilized at one or both ends of tubular member 42.

Adaptor assembly 40 further includes a radially extending bore or port 46 formed in the wall of the tubular member 42 to accommodate the passage of a flexible connecting tube or hose 48 therethrough. A first end of tube 48 is connected to a fitting or coupling 50 configured for sealing engagement with a outlet for municipally supplied water such, for example, as an outdoor or indoor faucet, garden hose, or the like. Illustratively, coupling 50 may comprise a conventional, threaded female hose fitting. In this regard, however, it should be noted that any fitting suitable for establishing sealed, fluid communication with a pressurized, municipal water supply may employed for the purposes of the present invention and that the specific type of fitting used is not deemed to be a novel aspect of the present invention. By way of further example, a rubberized tube with a graduated lip may be used to tightly, snugly, and quickly fit over almost any hose, spigot, or sink faucet.

Figure 2:
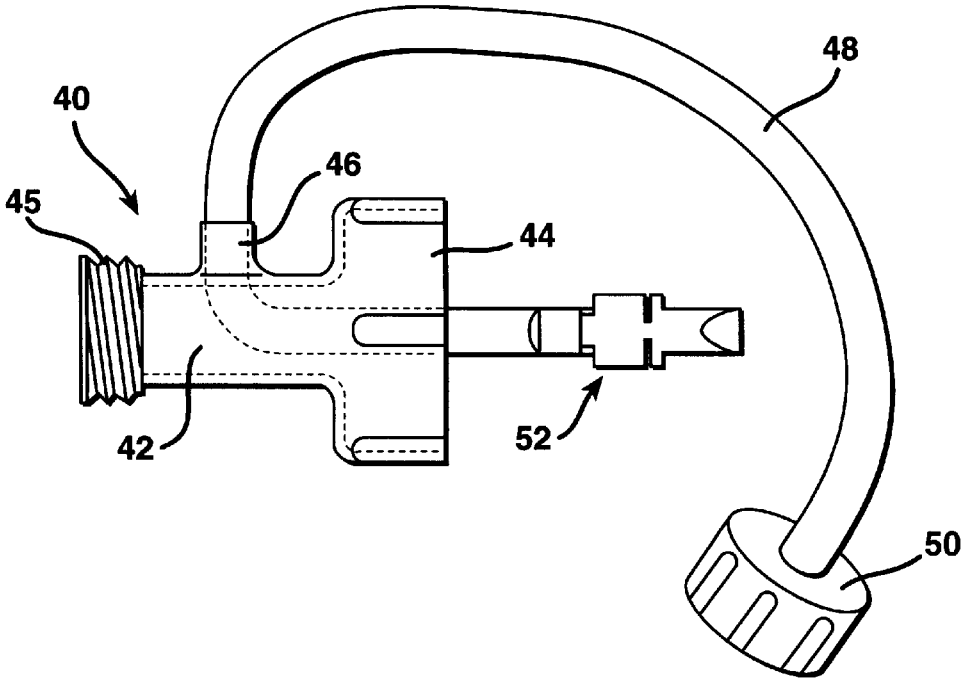
FIG. 2 is a perspective view of an adaptor assembly constructed in accordance with an illustrative embodiment of the present invention.
Figure 3:
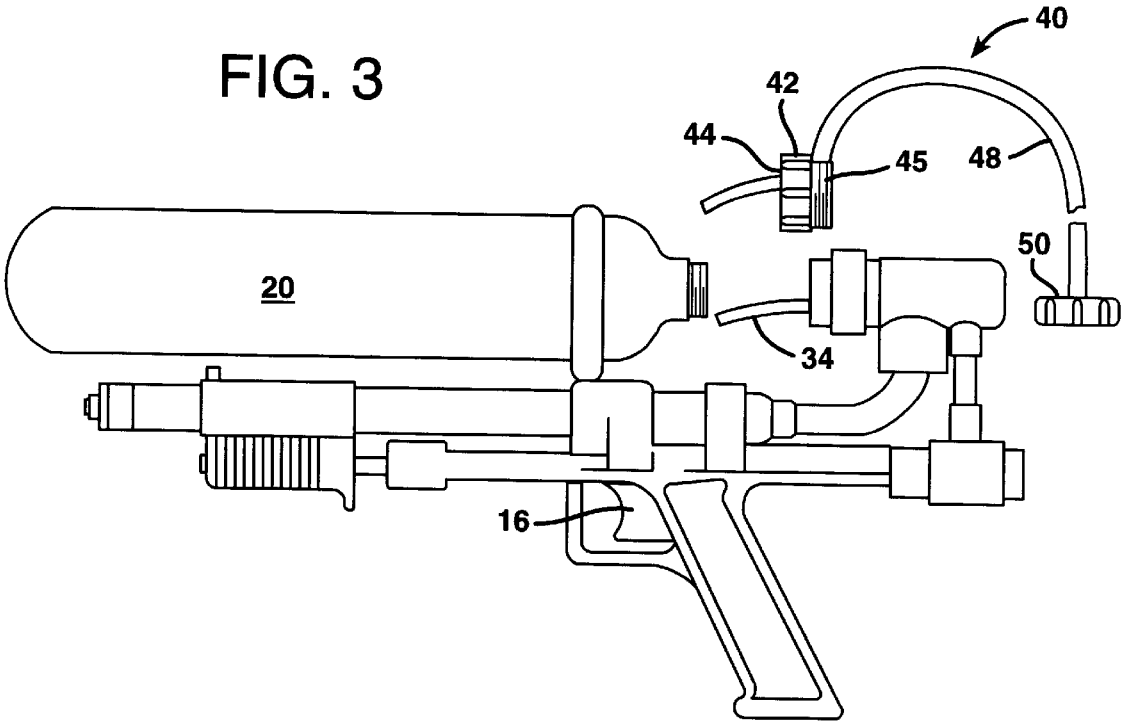
FIG. 3 is an exploded side elevation view depicting the modification of an existing pressurized water gun utilizing the inventive adaptor assembly of FIG. 2.
Figure 4:
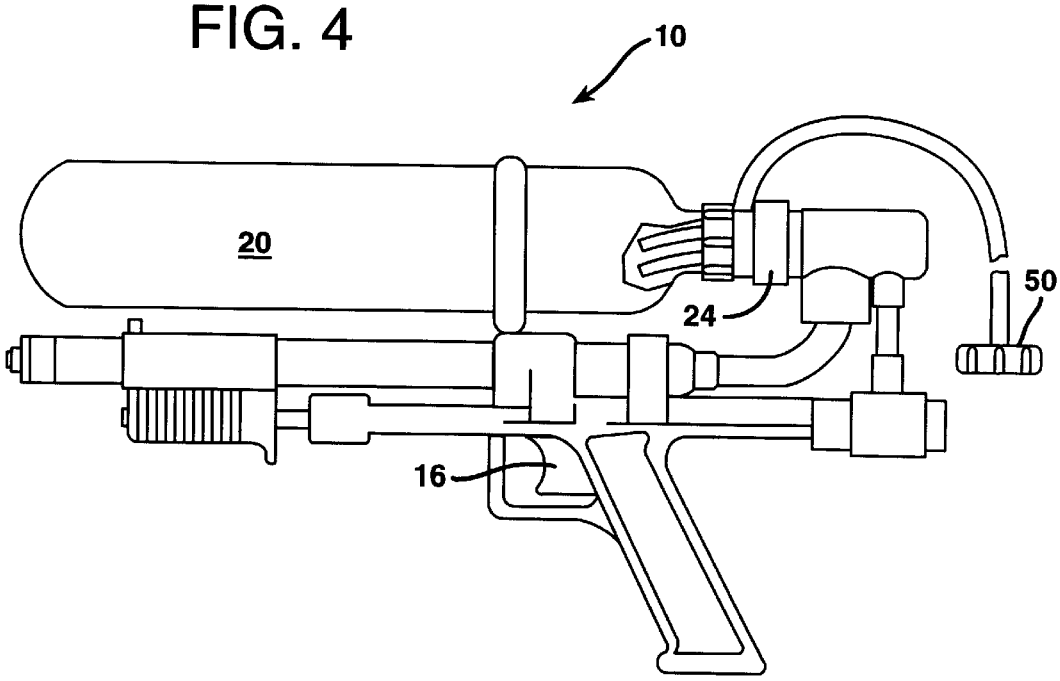
FIG. 4 is a side elevation view of a water gun constructed in accordance with an illustrative embodiment of the present invention.
Figure 5:
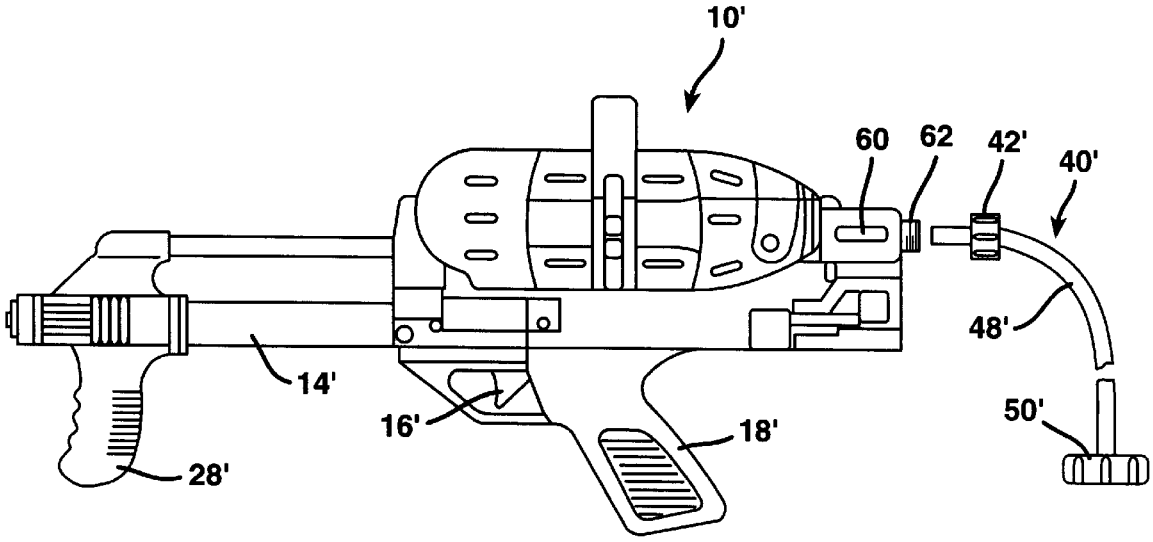
FIG. 5 is an exploded side elevation view depicted the modification of an existing pressurized water gun utilizing an adaptor assembly constructed in accordance with an alternate embodiment of the present invention.

In any event, and with continued reference to FIG. 2, it will be observed that a second end of tube 48 is connected to a one-way valve assembly 52, such that pressurized water available from a municipal water supply may be introduced into the tube 48 and thereafter into reservoir 20, when coupled therebetween in the manner shown in FIGS. 3 and 4. The one-way valve 52 may be any conventional one-way or check valve, such as a ball or flap valve or the like, which will permit the liquid to flow freely in one direction and which prevents the liquid from flowing in the opposite direction. The longitudinal bore of tubular member 42 is also dimensioned to accommodate the insertion of delivery tube 34, by which water is removed from reservoir 20 when the trigger 16 is depressed.

The operation of a water gun constructed in accordance with the embodiment of FIGS. 2–4 will now be described in detail. Hose fitting 50 is fitted on a hose bib (not shown) supplying pressurized water provided by a municipal water supply. The pressurized water is allowed to flow past a check valve into receptacle 20 which pressurizes the trapped air. When the pressure in the receptacle 20 equals the pressure of the municipal water supply, flow will stop. Hose fitting 50 can then be disconnected from the hose bib and the toy water gun system shown is ready for operation. If desired, additional pressure can be added manually using sliding handle 28.

Of course, if a source of municipal water is not available, the reservoir employed by the water gun of the present invention is instead, charged in the usual manner by unscrewing the reservoir from adaptor assembly 40 and filling it either by immersing it in a body of water or filling it with a stream of water from a water fountain or the like.

As suggested in FIG. 3, the adaptor assembly 40 of the present invention may be configured as a discrete component for use in modifying an existing water gun such as those of the type disclosed in U.S. Pat. No. 5,074,437. The adaptor assembly utilized in the complete system shown in FIG. 4, however, may alternatively be formed as an integral part of reservoir mount 24, thus obviating the need for an attachment between the latter and a second end as threaded second end 45.

It is also contemplated that the use of a discrete adaptor assembly in accordance with the present invention may be extended to a variety of other water gun configurations utilizing a pressurizing receptacle. Thus, for example, in FIG. 6 there is shown an adaptor assembly 40' modified to accommodate a water gun system 10' of the type in which the water reservoir 20' is not removable. In this embodiment, the adaptor assembly 40' is adapted to replace the conventional fill plug (not shown) which is screwed over threaded male port 60 of air/water manifold 62. For this purpose, adaptor assembly 40' is configured without a radial bore, with tube 48' being inserted through a port defined at one end of tubular member 42'. The opposite end of tubular member 42' is correspondingly threaded for sealing engagement with port 60 of the air water manifold.

Figure 6:
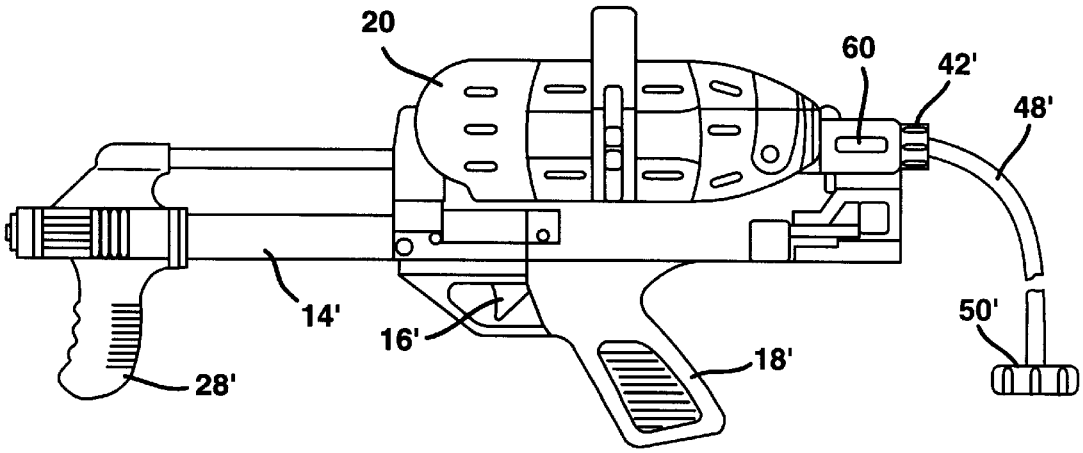
FIG. 6 is a side elevation view of a water gun constructed in accordance with the alternate adaptor assembly of FIG. 5.

As in the case with the previously described embodiment, the other end of tube 48' is connected to a conventional one-way valve (not shown) that is introduced into the interior of the air/water manifold 60 or, if desired, into the interior of reservoir 20, when tubular member 42' is screwed onto port 62 in the manner depicted in FIG. 6. As before, it should be noted that the tubular member 42' may alternatively be configured as an integral part of the air/water manifold 60.

Water guns constructed in accordance with the present invention exhibit substantially improved performance characteristics in comparison to such prior art configurations as the one depicted in FIG. 1. For example, the steps of filling the water reservoir and manually operating the pump to achieve an adequate pressure (e.g., 50 psi) typically requires approximately 2–3 minutes with the conventional apparatus of FIG. 1. The inventive embodiments of the present invention depicted in FIGS. 4 and 6, however, may be charged with water and pressurized to 70–90 psi in about 45 seconds. As such, not only is the pressurizing and filling operation substantially faster, but also the pressures which may be achieved utilizing a pressurized municipal water supply in accordance with the present invention are typically at least 20–40 psi higher than can be achieved using the manual pump alone.

The increased pressures afforded by the present invention, in turn, provide several key benefits. Specifically, it is now possible to generate a sustained discharge stream extending a distance easily in excess of 31 feet and lasting for over five to six minutes. Such results are quite spectacular when compared to those afforded by conventional configurations, which are typically limited to a range of 22 feet and a duration of only 55 seconds. In a water fight, the tactical advantages of a water gun capable of outlasting the competition by five minutes are quite obvious, indeed.

While the particular water guns and adaptor assembly as herein shown and described in detail are fully capable of attaining the above-described objects of the invention, it is to be understood that they are the presently preferred embodiments of the present invention and are thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims.

What is claimed is:

1. A high pressure, self contained, air pressurized toy water gun, comprising:

a housing;

an extended handle connected to said housing, a barrel portion of said housing extending outwardly away from said handle;

a nozzle having an orifice therethrough, said nozzle being affixed to the end of said barrel portion;

a high pressure, water storage reservoir having an orifice;

an avenue of release connecting said nozzle to said water storage reservoir;

a trigger located on said housing adjacent said handle;

a fluid interface assembly for selectively establishing one-way fluid communication between an external, pressurized water source and said water storage reservoir; and a pressurizing means with a slider, for pressurizing said water storage reservoir with air when an external pressurized source of water is unavailable or insufficient to adequately pressurize the water storage reservoir.

2. The water gun of claim 1, wherein said fluid interface assembly comprises a tubular portion defining a radial bore in a sidewall thereof, and a flexible tube extending through said radial bore.

3. The water gun of claim 2, wherein said fluid interface assembly further comprises a first fitting coupled to a first end of said flexible tube for sealing engagement with a supply fitting of said external source of pressurized water and a one-way valve coupled to a second end of said flexible tube, said one-way valve being operable to supply water under pressure from said external source to said reservoir.

4. The water gun of claim 2, wherein said tubular portion has a first open end, and wherein at least one of said reservoir and said housing defines a threaded surface portion engageable with said first open end to establish a fluid tight communication therebetween.

5. The water gun of claim 4, wherein said tubular portion has a second open end, and wherein another of said reservoir and said housing defines a second threaded surface portion engageable with said second open end to establish a fluid tight communication therebetween.

6. The water gun of claim 1, wherein said fluid interface assembly comprises a tubular portion defining a longitudinal bore dimensioned to receive a flexible tube extending therethrough.

7. The water gun of claim 6, wherein said fluid interface assembly further comprises a first fitting coupled to a first end of said flexible tube for sealing engagement with a supply fitting of said external source of pressurized water and a one-way valve coupled to a second end of said flexible tube, said one-way valve being operable to supply water under pressure from said external source to said reservoir.

8. The water gun of claim 7, wherein said tubular portion has a first open end, and wherein said housing defines a threaded surface portion engageable with said first open end to establish a fluid-tight connection therebetween.

9. The toy water gun of claim 1, wherein said reservoir is operable to store pressurized water to a pressure greater than 50 psig.

10. The toy water gun of claim 9, wherein said reservoir is operable to store pressurized water to a pressure of from 70–90 psig.

11. An adapter assembly for use with a high pressure, self-contained, air pressurized toy water gun of the type including a housing, an extended handle connected to the housing, a barrel portion of the housing of extending outwardly away from the handle, a nozzle having an orifice therethrough, the nozzle being affixed to the end of the barrel portion, a high pressure, water storage reservoir having an orifice, an avenue of release connecting the nozzle to the water storage reservoir, a trigger located on the housing adjacent the handle, a regulator connected to the avenue of release for regulating the flow of water and air through the avenue of release, and a pressurizing assembly with a slider, for pressurizing the reservoir with air when an external pressurized source of water is unavailable or insufficient to adequately pressurize the water storage reservoir, the adapter comprising:

a fluid interface assembly for selectively establishing one-way fluid communication between an external, pressurized water source and the water storage reservoir, said fluid interface assembly including a one-way valve, wherein said fluid interface assembly includes a tubular portion defining an open end securable to at least one of the reservoir and housing to establish a fluid tight seal therewith, said fluid interface assembly further including a flexible tube having a first open end in fluid communication with an axial cavity of the tubular portion and a second end connectable to an external pressurized source of water.

12. The adapter assembly of claim 11, wherein said fluid interface assembly further comprises a fitting coupled to said second end of said flexible tube for sealing engagement with a supply fitting of the external source of pressurized water.

13. The adapter assembly of claim 12, wherein said one way valve is coupled to said first end of said flexible tube, said one-way valve being operable to supply water under pressure from said external source to said reservoir.

14. The adapter assembly of claim 11, wherein said tubular portion has a second open end securable with another of the reservoir and the housing to provide a fluid tight seal therewith.

15. A high pressure, self contained, air pressurized toy water gun comprising:

a housing;

an extended handle connected to said housing, a barrel portion of said housing extending outwardly away from said handle;

a nozzle having an orifice therethrough, said nozzle being affixed to the end of said barrel portion;

a high pressure, water storage reservoir having an orifice, said reservoir being configured to store pressurized water to a pressure greater than 50 psig;

an avenue of release connecting said nozzle to said water storage reservoir;

a trigger located on said housing adjacent said handle; and a fluid interface assembly for selectively establishing one-way fluid communication between an external, pressurized water source and said water storage reservoir, said fluid interface assembly including a one-way valve and a first tubular portion defining an open end securable to at least one of the reservoir and housing to establish a fluid tight seal therewith and a second tubular portion dimensioned and arranged for mating sealing engagement to a pressurized source of water external to said reservoir; and a manually operable pressurizing assembly for pressurizing said water storage reservoir with air when an external pressurized source of water is unavailable or insufficient to adequately pressurize the water storage reservoir.

16. A method of charging a high pressure, self contained air pressurized toy water gun of the type comprising a housing, an extended handle connected to the housing, a barrel portion of the housing extending outwardly away from said handle, a nozzle having an orifice therethrough affixed to the end of the barrel portion, a water storage reservoir configured to store pressurized water to a pressure greater than 50 psig and having an orifice, an avenue of release connecting said nozzle to the water storage reservoir, a manually operable pressurizing assembly for pressurizing said water storage reservoir with air when an external pressurized source of water is unavailable or insufficient to adequately pressurize the water storage reservoir, and a trigger located on the housing adjacent the handle, comprising the steps of:

providing a fluid interface assembly for selectively establishing fluid communication between an external, pressurized water source and the water storage reservoir, said fluid interface assembly including a first tubular portion defining an open end securable to at least one of the reservoir and housing to establish a fluid tight seal therewith and a second tubular portion dimensioned and arranged for mating sealing engagement to a pressurized source of water external to said reservoir;

securing the first tubular portion to one of the reservoir and the housing to establish a fluid tight seal therewith;

securing the second tubular portion to a pressurized source of water external to the reservoir; and causing water to flow from the pressurized source of water through said fluid interface assembly into the reservoir until the reservoir is charged with a desired amount of water under pressure sufficient to cause ejection of water through the nozzle orifice upon depression of the trigger.

17. The method of claim 16, further including a step of operating the pressuring assembly to pressurize the water storage reservoir with air.

* * * * *